US007211056B2

(12) United States Patent
Petelenz et al.

(10) Patent No.: US 7,211,056 B2
(45) Date of Patent: May 1, 2007

(54) DEVICE FOR CHEST AND ABDOMINAL COMPRESSION CPR

(76) Inventors: Danuta Grazyna Petelenz, 2520 Blaine Ave., Salt Lake City, UT (US) 84108; Tadeusz Karol Petelenz, ul. Szeligiewicza 12/21, Katowice (PL) 40-074

( * ) Notice: Subject to any disclaimer, the term of this patent is extended or adjusted under 35 U.S.C. 154(b) by 234 days.

(21) Appl. No.: 10/927,865

(22) Filed: Aug. 28, 2004

(65) Prior Publication Data

US 2006/0047228 A1 Mar. 2, 2006

(51) Int. Cl.
*A61H 31/00* (2006.01)

(52) U.S. Cl. ..... 601/41; 601/DIG. 6

(58) Field of Classification Search ..... 601/41, 601/44, 152
See application file for complete search history.

(56) References Cited

U.S. PATENT DOCUMENTS 651,962 A * 6/1900 Boghean ..... 601/41
3,120,228 A 2/1964 Huxley, III
3,481,327 A 12/1969 Drennen
3,777,744 A 12/1973 Fryfogle et al.
4,004,579 A * 1/1977 Dedo ..... 601/41
4,349,015 A 9/1982 Alferness et al.
4,424,806 A 1/1984 Newman et al.
4,664,098 A 5/1987 Woudenberg et al.
4,770,164 A 9/1988 Lach et al.
4,915,095 A * 4/1990 Chun ..... 601/43
4,928,674 A 5/1990 Halperin et al.
5,222,478 A 6/1993 Scarberry et al.
5,287,846 A * 2/1994 Capjon et al. ..... 601/44
5,295,481 A 3/1994 Geeham et al.
5,454,779 A 10/1995 Lurie et al.
5,490,820 A 2/1996 Schock et al.
5,630,789 A 5/1997 Schock et al.
5,645,522 A 7/1997 Lurie et al.
5,738,637 A 4/1998 Kelly et al.
5,891,062 A 4/1999 Schock et al.
6,059,742 A * 5/2000 Palmer ..... 601/41
6,234,984 B1 5/2001 Kelly et al.
6,325,771 B1 12/2001 Kelly et al.
6,447,465 B1 9/2002 Sherman et al.

(Continued)

FOREIGN PATENT DOCUMENTS

JP 2001-299858 * 10/2001

OTHER PUBLICATIONS

Cummins et al. "Recommended Guidelines for Uniform Reporting of Data From Out-of-Hospital Cardiac Arrest: The Utstain Style", Circulation, 1991; 84, No. 2:960-975.

(Continued)

*Primary Examiner*—Danton DeMille

(57) ABSTRACT

Portable, lightweight manually actuated CPR device for performing enhanced external thoracic massage. When applied to the victim, the device is used to perform chest, or chest and abdominal compression cardiopulmonary resuscitation (CPR). The device provides mechanical force advantage over manually-performed external thoracic massage and permits performing multiple, repeatable and controlled compression/decompression cycles in rapid succession. The system requires less physical strength and endurance than the traditional external thoracic massage, and can be used by persons who otherwise are not strong enough to perform effective CPR. The device can be used with external ECG and defibrillation electrodes and equipment, is lightweight and portable, and can be used by both professional and lay rescuers.

11 Claims, 11 Drawing Sheets

U.S. PATENT DOCUMENTS

| | | | | |
|---|---|---|---|---|
| 6,645,163 | B2 | 11/2003 | Kelly et al. | |
| 6,676,613 | B2 | 1/2004 | Cantrell et al. | |
| 2004/0181179 | A1 * | 9/2004 | Hwang | 601/44 |

OTHER PUBLICATIONS

Bottiger et al. "Long Term Outcome after out-of-hospital cardiac arrest with physician staffed emergency medical services", Heart a1999; 82: 674-679.

Varon J. et al. Cardiopulmonary resuscitation a reviev for clinicians resuscitation. 1998; 36 :133-145.

Kern KB, Coronary Perfusion Pressure During Cardiopulmonary Resuscitation. Bailliere's Clinical Anaesthesilogy, 2000; 14(3): 591-609.

Circulation, 2000; 102:1-2, 34-39.

Ochoa FJ, "The Effect of Rescuer Fatigue on the Quality of Chest Compressins", Resuscitation 1998; 37:149-152.

Varon et al. Cardiopulmonary Resuscitation: Current Status, Hospital Physician; Nov. 2001:33-40; www.turner-white.com.

Barranco et al. Cardiopulmonary resuscitation with simultaneous chest and abdomen compression : comparative study in humans. Resuscitation 1990; 20 : 67-77.

Cantrell "Elcare's Crystal Ball" ; Elroy Cantrell Lecture, Nov. 2000, Texas College of Osteopathic Medicine; www. elcare.cc/products. htm.

Petelenz, et al., Efficacy of resuscitative external thoracic massage with simultaneous abdominal compression Ł a pilot study, ESC Congress 2004, Munich.

* cited by examiner

DEVICE FOR CHEST AND ABDOMINAL COMPRESSION CPR

CROSS REFERENCE TO RELATED APPLICATIONS

Not Applicable

FEDERAL SPONSORED RESEARCH

Not Applicable

SEQUENCE LISTING OF PROGRAM

Not Applicable

BACKGROUND OF THE INVENTION—FIELD OF INVENTION

This invention relates to enhanced devices for cardiopulmonary resuscitation (CPR), specifically to an improved apparatus for increasing blood flow in vessels providing blood supply to the heart and the brain by compression and decompression of the chest and abdominal cavities of a person suffering from cardiac arrest.

BACKGROUND OF THE INVENTION

Over 450,000 people die each year from cardiac arrest caused by heart attack, electric shock, near-drownings, heart diseases, or other causes, making the cardiac arrest the single largest cause of death in the United States. Cardiac arrest results in rapid loss of circulatory function and imminent death unless Cardiopulmonary Resuscitation (CPR) is applied within minutes of the event. Standard manual CPR performed according to the method originally described by Kouwenhoeven has low efficacy (approx. 10%) and high level of complications; more than fifty percent of saved victims suffer from consequential severe brain damage (1,2) and the number of neurologically intact survivors of an out-of-hospital cardiac arrest is only between 1–8%. (3) The resuscitation outcome depends largely on the skills of the rescuer but even when performed correctly, manual CPR provides only 20–30% of blood normally supplied to the heart and the brain. (4) CPR provides cardiac support through a series of rhythmic compressions of the victim's thorax alternated (15:1) with mouth-to-mouth ventilation. Traditional thoracic compression is achieved by placing the patient in the recovery (supine) position, having the rescuer place his/her hands on the victim's sternum and pressing down. According to the current AHA guidelines, sternum compressions should be performed at a rate of 100 per minute, with the target deflections of the sternum between 1.5 and 2 inches (4–5 cm) during each compression. (5) On the average, each chest compression requires about 50 kG force applied by rescuer. Coronary blood flow during resuscitation—a critical determinant of recovery—is significantly higher if the compressions are rapid and performed with minimum interruptions. Maintaining such a high rate and pressure requires considerable physical effort of the person administering the CPR, and fatigue sets in quickly. According to literature, more than 25% of CPR is done incorrectly and fatigue is observed after only 1 minute of intense compressions even in the most highly trained rescuers. (6) As a person administering the CPR becomes tired, the efficiency of the CPR decreases, and so do the victim's chances of recovery, especially in view of the fact that it is sometimes necessary to carry out CPR for periods of time exceeding 30 minutes. In summary, traditional CPR has its limitations: the method is tiring to the rescuer, is not efficient, and commonly provides insufficient cardiopulmonary support to the victim.

A variety of the devices have been developed to increase blood flow and/or pressure in the chest cavity of the cardiac arrest victim and the number of improvements have been made to the currently available CPR procedure and instrumentation.

Kelly, et al. in U.S. Pat. No. 6,645,163, U.S. Pat. No. 6,325,771, U.S. Pat. No. 6,234,984, U.S. Pat. No. 5,738,637 discloses wide belts, circumferentially wrapped around chest, compressing chest and causing a force directed tangentially to the chest when tightened. Conceptually very similar device is described by Cantrell et al. in U.S. Pat. No. 6,676,613. Additionally Cantrell mentions possibility of using the device with a pressure abdominal binder. Binding the abdomen results in diminishing the pulsating nature of the blood flow, characteristic of normal physiology, and is undesirable during CPR. Lach et al. in U.S. Pat. No. 4,770,164 proposes compression of the chest with wide band and a pool roller, applying a side-to-side clasping action to the chest to induce compressions. The belt conforms substantially to the contour of the thorax around a major portion of its periphery and when tightened, the band exerts the clasping action, and produces force tangential to the major portion of the chest.

Most of the chest compression enhancing devices rely on a belt wrapped conformally around the chest and when the belt gets shorter it squeezes the chest around its circumference.

Abdominal compression is a technique used to enhance the effectiveness of the CPR chest compression. The use of devices for abdominal compression was proposed to enhance air exhalation from the lungs. The abdominal compression may be performed in synchrony with the chest compressions, either simultaneously or in a counter pulsation mode in relation to the chest compressions. The abdominal compression may be held in a static condition during a series of chest compressions, and can even be performed without accompanying chest compression to create blood flow. Abdominal binding during chest compression limits the decrease of compressive pressure as it limits the deformation of the abdominal cavity secondary to the compression of the chest. It also inhibits flow of blood into the lower extremities and promotes blood flow to the brain. The abdominal compression can be achieved using mechanical pressing devices or devices electrically stimulating respiratory muscles in order to push the diaphragm upwards. Examples of devices that involve abdominal compressions are described below.

In U.S. Pat. No. 3,777,744, Fryfogle et al. teaches a breathing aid consisting of a belt and a handle which tightens the belt for expelling excessive residual air from the lungs. This device does not provide the circulatory enhancement that is required for properly-performed CPR.

Lung inflation plus abdominal binding approach is disclosed in U.S. Pat. No. 4,424,806, which describes synchronized lung inflation and abdominal compression using gas powered bladders. This device relies on an actuation mechanism that is complicated and potentially slow in action.

The use of inflatable bladders positioned around the chest and/or the abdomen alone or in the vest has also been disclosed in U.S. Pat. No. 5,490,820, U.S. Pat. No. 5,222,478, U.S. Pat. No. 4,928,674, U.S. Pat. No. 4,664,098, U.S.

Pat. No. 4,424,806, U.S. Pat. No. 3,481,327, U.S. Pat. No. 3,120,228, and U.S. Pat. No. 3,042,024.

In U.S. Pat. No. 4,349,015, Alferness teaches providing an abdominal restraint during the compression cycle with a bladder that is filled with gas during compression. It applies slight pressure to the abdomen interposed between consecutive chest compressions (Interposed Abdominal Compressions—IAC).

The device described in U.S. Pat. No. 6,447,465 requires an electrical power source to operate. It performs circumferential chest compressions and may also provide abdominal binding and/or IAC through circumferential tightening of the abdomen. Tightening the abdomen without periodic relaxation of pressure may be dangerous because of potential trauma to abdominal organs as the pressure in the abdominal cavity increases with each subsequent chest compression, and the organs cannot relax, and return to their original natural position.

A manual device for IAC is disclosed in Shock, et al., in U.S. Pat. No. 5,630,789, and U.S. Pat. No. 5,891,062. The device is similar to a seesaw mounted over the chest with a contact cup on each end of the seesaw. One end of the seesaw is mounted over the chest (sternum), and the other end is mounted over the abdomen, and the device is operated by rocking the seesaw back and forth, alternately applying downward force on each end. The device is used in what is called an active compression-decompression (ACD) method. The ACD CPR relies on a compression of the chest followed by an active lifting of the chest using an adhesive pad or a suction cup. The ACD is also used on the abdomen in IAC when the abdomen is actively lifted during chest compression. The devices using ACD methods for performing CPR are also described in U.S. Pat. No. 5,454,779, U.S. Pat. No. 5,645,522, and U.S. Pat. No. 5,295,481.

Clinical efficacy studies are inconclusive in assessing the clinical outcomes resuscitation from cardiac arrest with the use of existing devices for IAC-CPR or ACD-CPR methods. (7) Devices for ACD-CPR must use a strong skin adhesive and are difficult to use, and devices for both IAC-CPR and ACD-CPR require more physical strength from the rescuer than the traditional chest CPR. Moreover, alternative compressions of the chest and abdomen result in pumping blood under nearly constant pressure, which is non-physiological, as the natural blood pressure is pulsating.

The compressive, powered devices for Cardiopulmonary Resuscitation use various mechanical, electrical, pneumatic, and hydraulic components. Such devices include chest squeezers, chest thumpers, pistons and sternal depressors in various configurations. They are generally expensive, heavy, cumbersome, difficult to deploy, require electrical energy (e.g., charged batteries) and special skills to operate, and can operate only over limited period of time without recharging.

In standard, or traditional CPR, the main difficulty in maintaining sufficient blood pressure in the thorax during the chest compressions is due to the fact that the diaphragm in an unconscious person loses its muscle tone and the compression of the chest shifts the diaphragm towards the abdomen, reducing pressure in chest cavity (the thorax).

Simultaneous compression of both the chest (sternum) and the abdomen (sterno-abdominal compression) prevents downshift of the diaphragm, increasing pressure in the thorax. Barranco et al., demonstrated that using the simultaneous sterno-abdominal compression, blood pressure in the aorta reaches significantly higher values (over 90 mmHg) than those during traditional chest compression, which usually results in aortic pressure of about 40 mmHg, and is insufficient for adequate perfusion of the brain and other vital organs. (8)

An alternative to the current standard chest-only compression CPR, is a modified CPR method that uses both chest and abdominal compressions. Scientific research shows that such a procedure results in better cardio and cerebral perfusion. However, simultaneous abdominal compression CPR (SAC-CPR) can be exceedingly tiring and difficult for a single rescuer. None of the existing devices can be used by a single rescuer to perform an enhanced CPR with simultaneous chest and abdominal compressions.

Despite many advancements in CPR methods, significant improvements in clinical outcomes did not follow.

In summary, there is a need for an improved device for performing chest compression CPR, as well as a modified chest and abdominal compression CPR, that could be used by a single rescuer, be less tiring, require less physical effort to operate and that produces better clinical outcomes in saving lives of the cardiac arrest victims.

BACKGROUND OF THE INVENTION—OBJECTS AND ADVANTAGES

None of the devices known to the inventors is used to apply simultaneous chest (sternum) and abdominal compressions CPR despite the fact that such a method produces the highest systolic intravascular pressure and carotid flow, (9, 10) which is known from scientific research to be helpful during the resuscitation of the victims of cardiac arrest.

Physiological and clinical studies indicate that CPR based on simultaneous chest and abdominal compressions rather than on the external thoracic compression alone is more effective in generating aortic blood pressures comparable, or even higher than the minimum pressure adequate to sustain circulation (above 80–90 mmHg).

The disclosed CPR device can be used in standard chest compression CPR, SAC-CPR and IAC-CPR, is light weight, easy to use, and inexpensive to manufacture. The use of the device is less tiring to the rescuers due to the force amplification mechanism, and the device can be operated by one person of average size and strength.

In contrast to other devices known in the art, the device of this invention avoids circumferential compression of the chest and/or abdomen, relying instead on the depressing of the chest and the abdomen in the direction perpendicular to the anterior part of the body to create cardiac and thoracic pump mechanisms for pumping blood through the inactive heart into the vital organs of the body. Further objects and advantages of this invention will become apparent from a consideration of the drawings and the ensuing description.

SUMMARY—BRIEF DISCLOSURE OF THE INVENTION

This invention pertains to a new device and method of performing cardiopulmonary resuscitation by external thoracic massage that demands less physical effort than the traditional, mechanically unaided CPR. The invention comprises a device that enables both standard chest compression CPR, as well as the related methods that employ both chest compression and abdominal compression to enhance CPR, such as Simultaneous Abdominal Compression CPR (SAC-CPR) and Interposed Abdominal Compression CPR (IAC-CPR), by a single rescuer. The device of this invention provides mechanical force amplification and the coordination of the compressions of the chest and the abdomen during CPR, resulting in lower physical effort that is required to perform the standard, manual CPR, enabling the single rescuer to perform the treatment for prolonged period of time. The device action relies on applying the force to the actuator lever and converting the direction of the force mostly perpendicularly, and not circumferentially, to the chest and/or to the abdomen. The inherent versatility of the device configurations enables the rescuer to perform CPR using the procedure that is the most appropriate for the victim. The device and method of this invention are inexpensive, easy and fast to deploy, do not require electrical power, or mechanical assistance to operate, and are easy to learn and use.

DRAWINGS—BRIEF DESCRIPTION OF THE DRAWINGS

This section provides brief description of the drawings that illustrate the invention and serve as examples of possible embodiments of the device. In the drawings, closely related figures have the same number but different alphabetical suffixes.

Figure 3B:
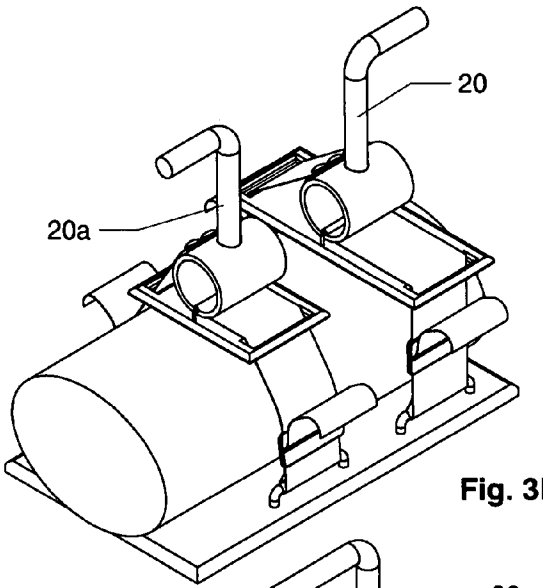
Figure 3A:
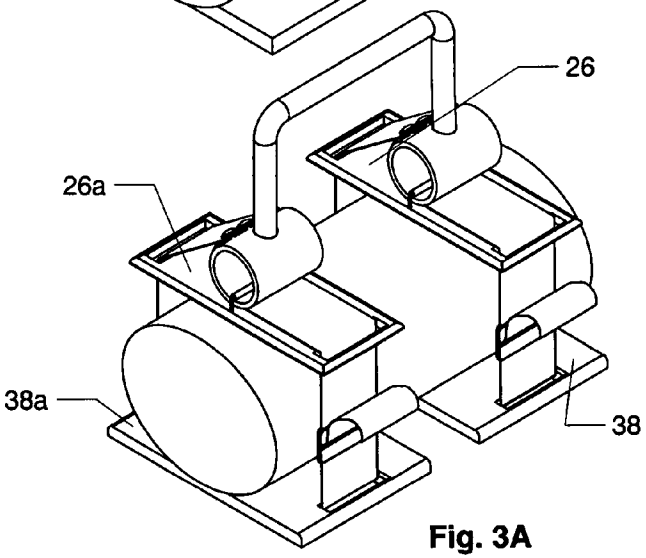
Figure 3:
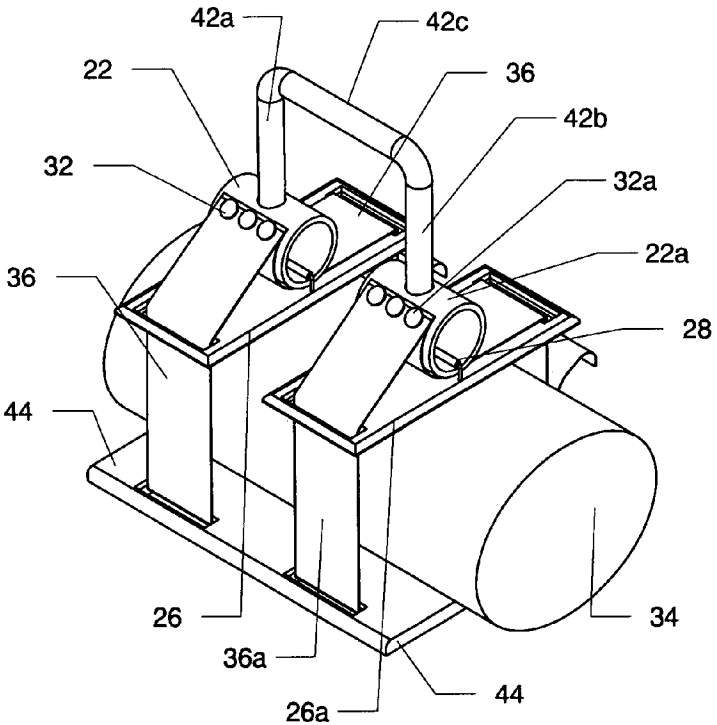

FIGS. 3 and 3A, and 3B show both the first and the second section of the device deployed around the chest and the abdomen, alternatively using either a single, or dual backboards.

Figure 4:
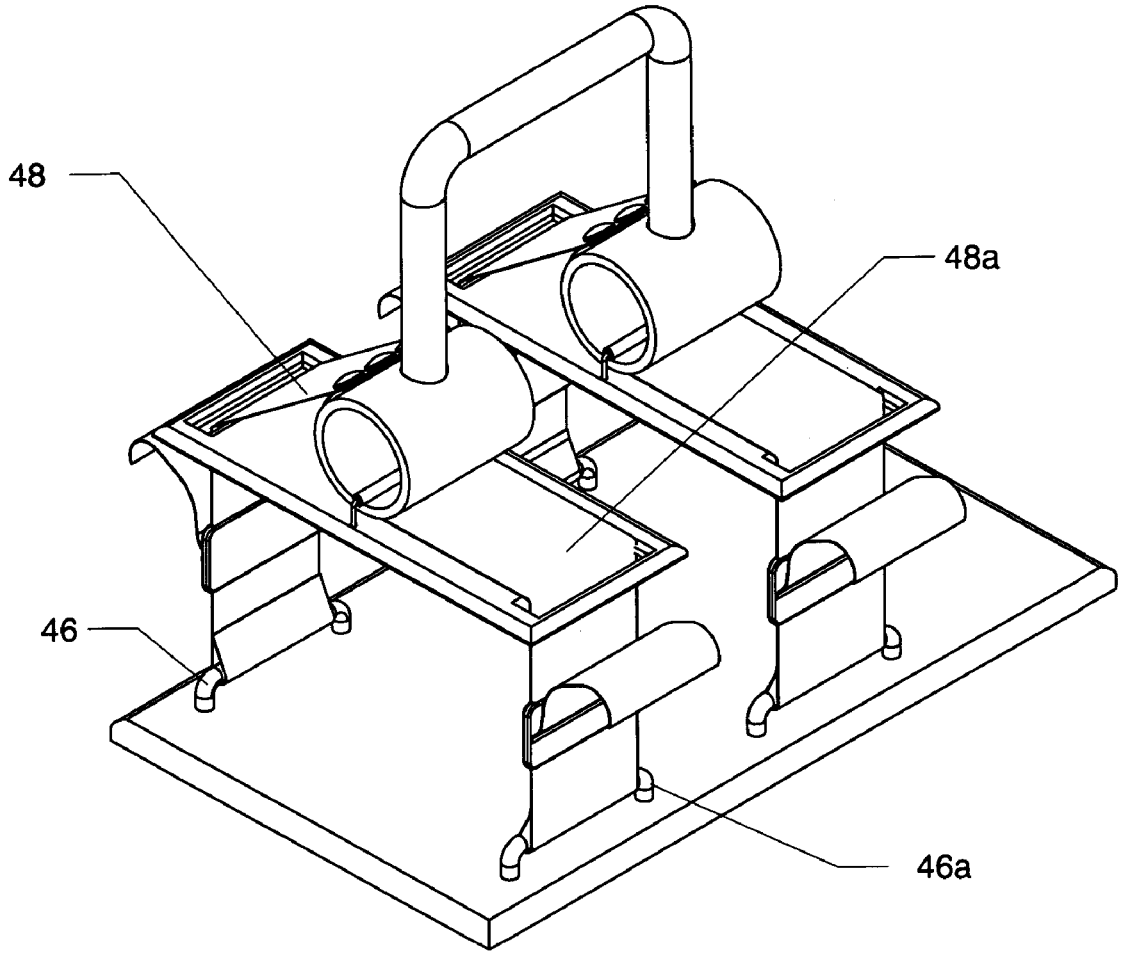

FIG. 4 illustrates an alternative method of attaching the straps of the device of this invention to the backboard using attachment loops and attachment handles instead of routing the straps underneath the backboard.

Figure 5A:
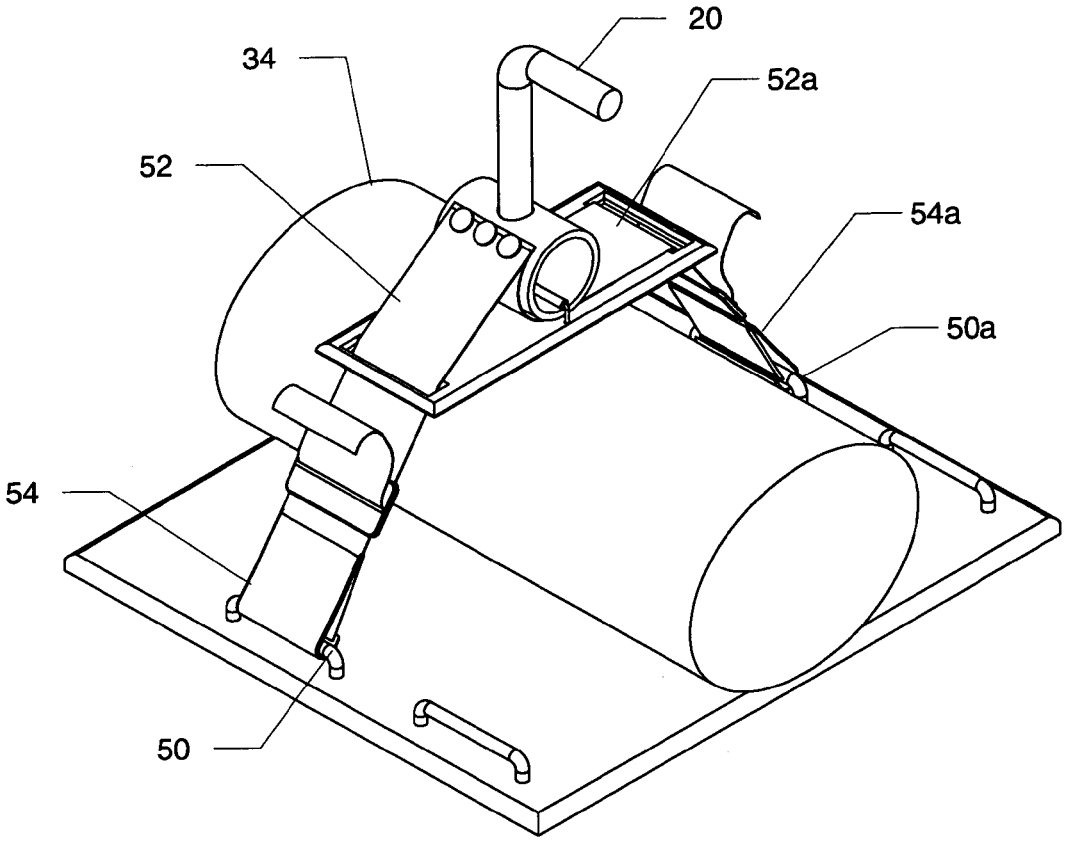
Figure 5:
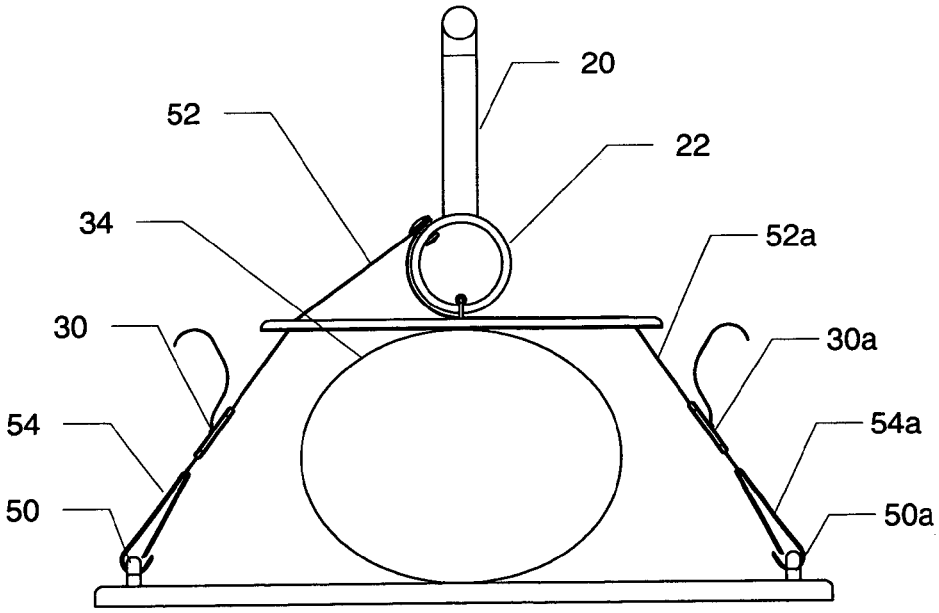

FIGS. 5 and 5A show an example of an alternative method of attaching the device to an alternative backboard such as an oversized backboard, a stretcher or a bed, in side and isometric views, respectively.

Figure 6:
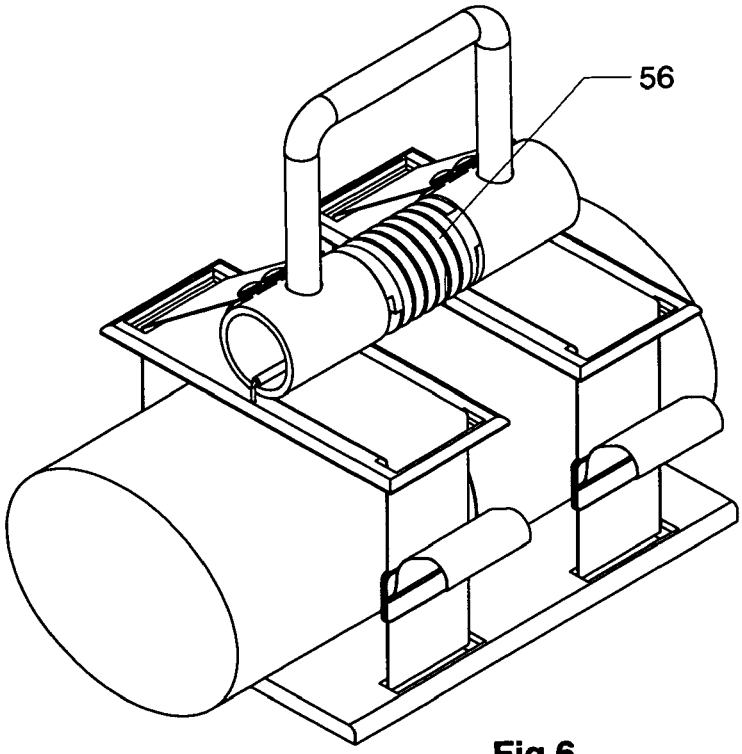

FIG. 6 shows the device in which the actuator rollers of the first section and the second section of the device are interconnected.

Figure 7:
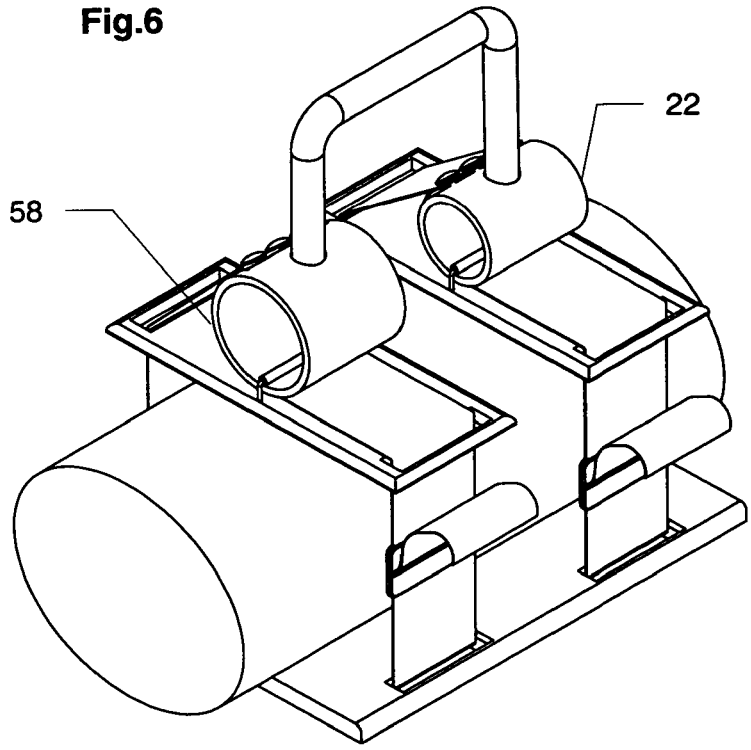

FIG. 7 illustrates an embodiment of the device in which the first and the second actuators are of different size.

Figure 8:
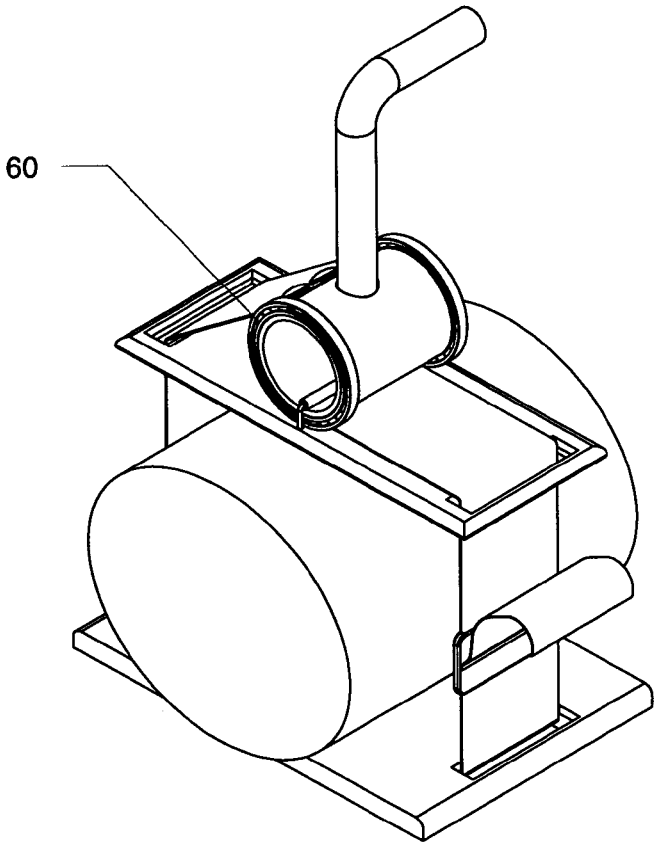
Figure 8A:
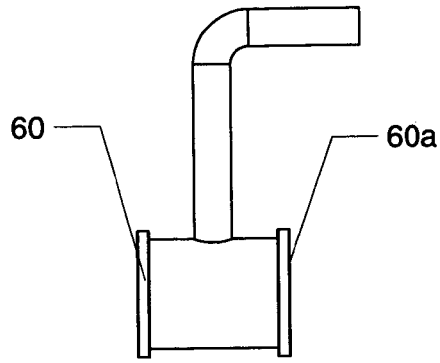
Figure 8B:
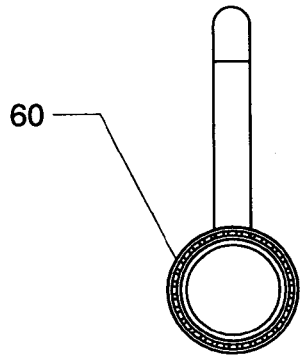

FIGS. 8, 8A, 8B illustrate the devices with the actuator using bearings.

Figure 9:
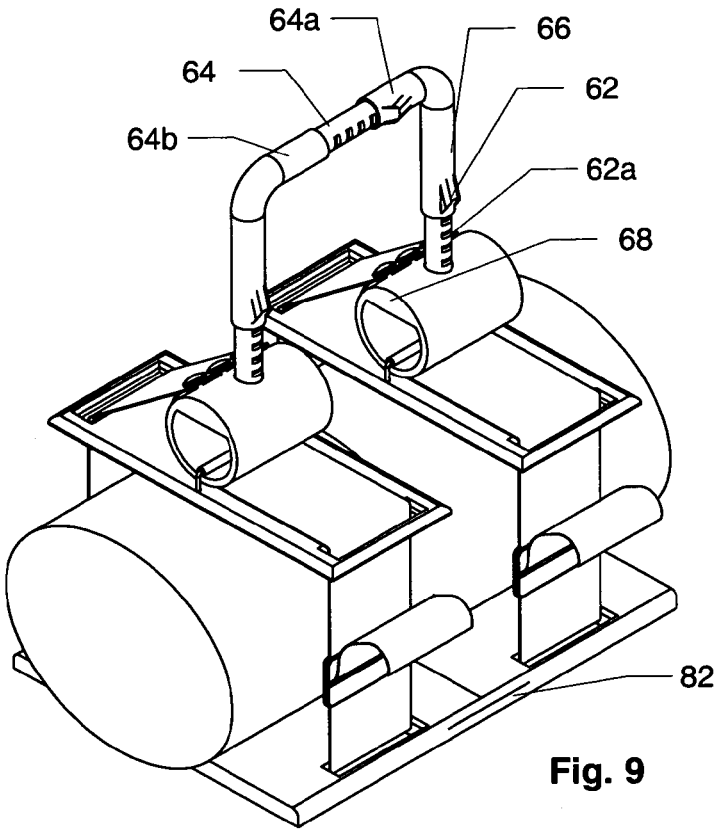

FIG. 9 shows the device with adjustable handles and adjustable distance between the first and the second section of the device.

Figure 10:
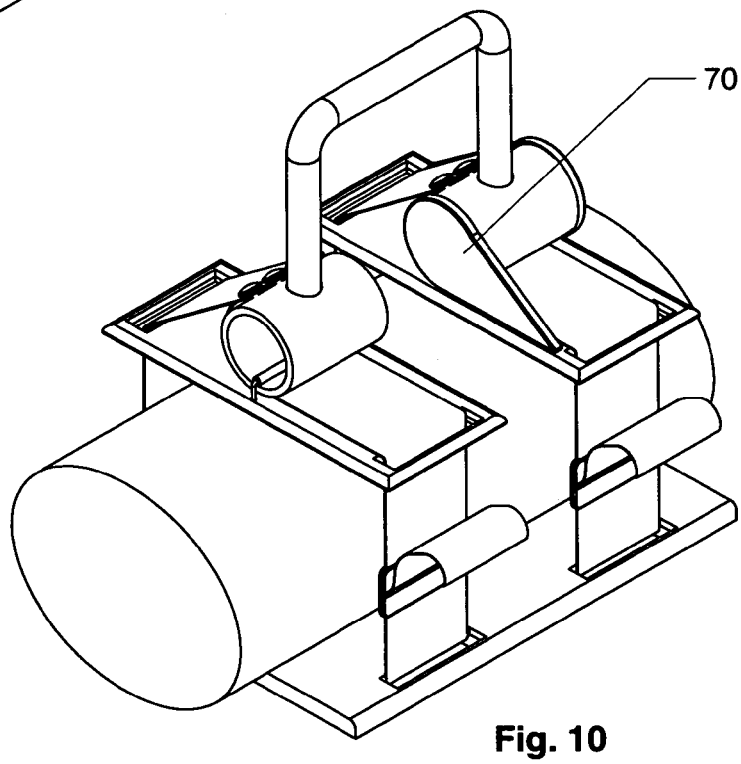

FIG. 10 shows the device with force/rotation/torque gauges, limiters or controllers attached to the actuator.

Figure 11A:
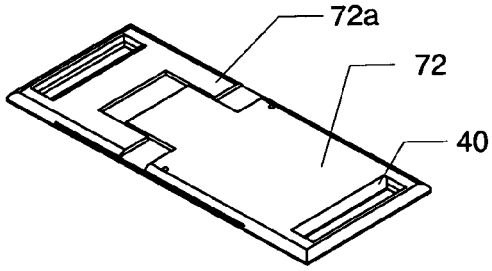
Figure 11B:
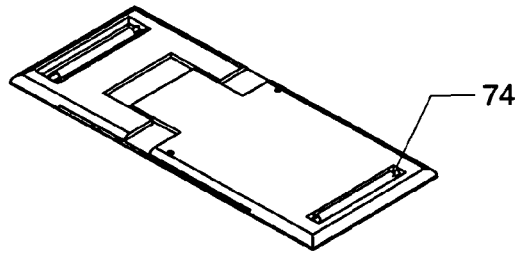
Figure 11C:
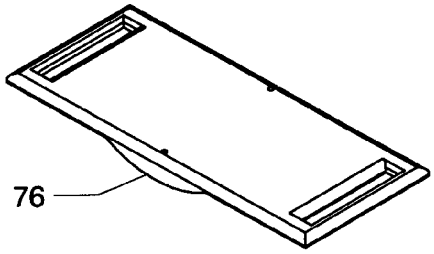
Figure 11D:
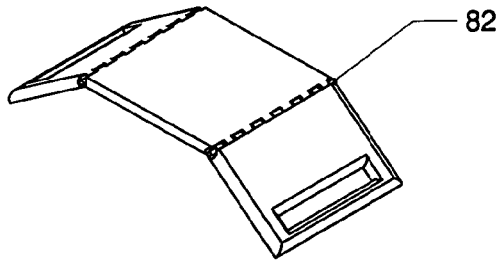
Figure 11:
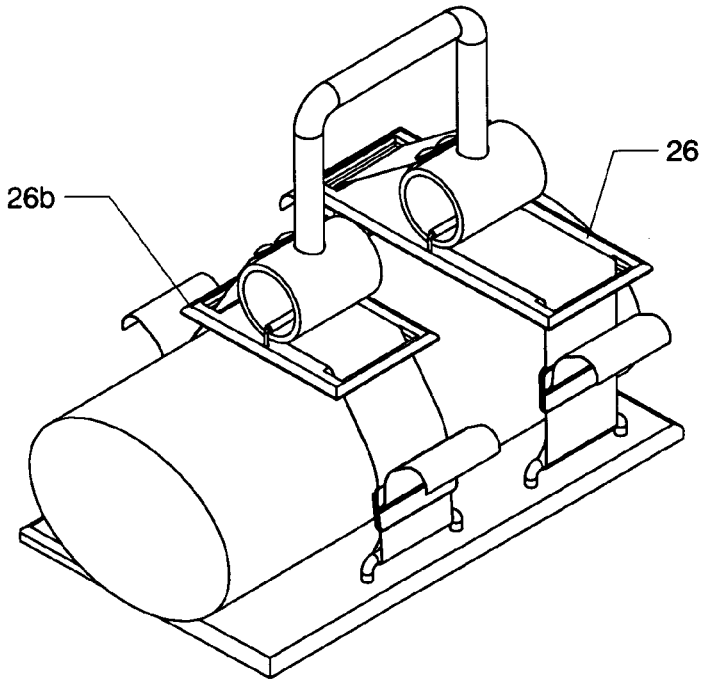

FIG. 11 shows a device with two boards being of different size.

FIGS. 11A, 11B, 11C, 11D show boards of different shape, adjustable, padded, and equipped with different strap routing guides.

Figure 12:
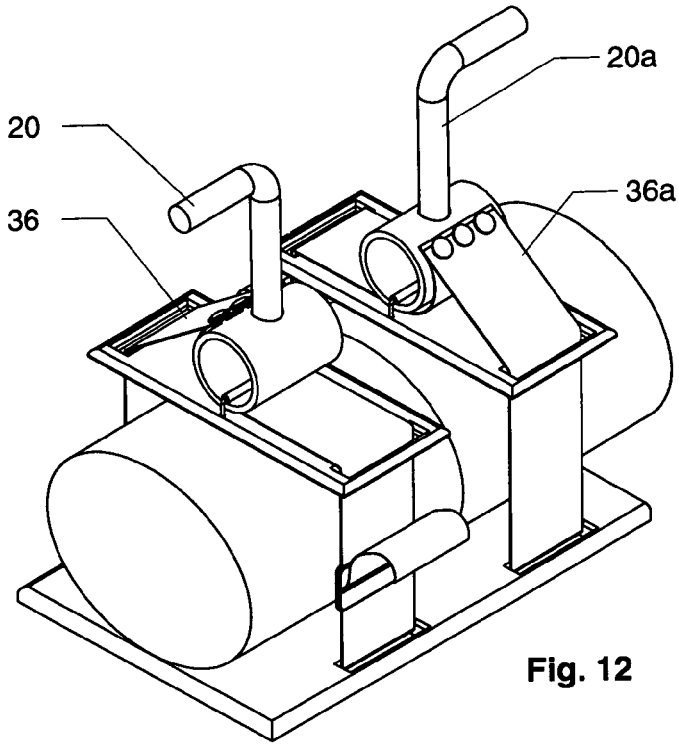

FIG. 12 shows the device configuration for performing either Simultaneous or Interposed Abdominal Compression CPR.

Figure 13:
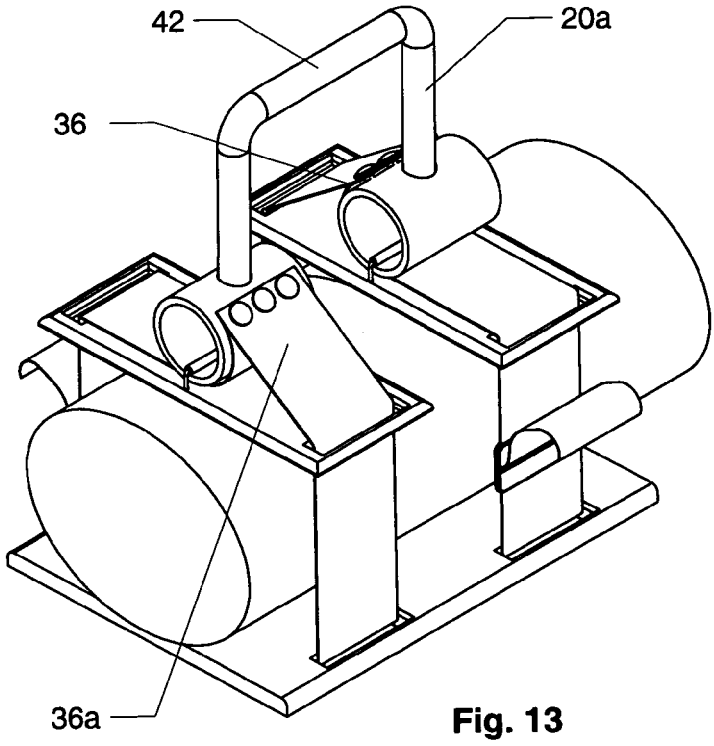

FIG. 13 shows the device configuration for IAC.

Figure 14:
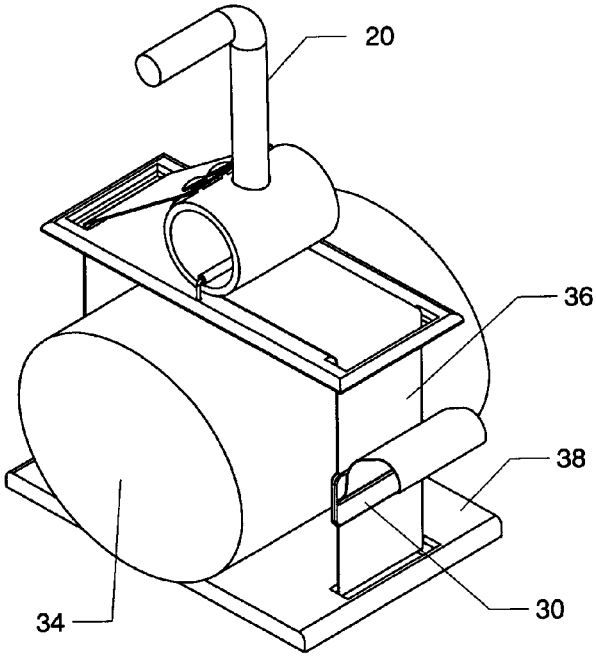
Figure 14A:
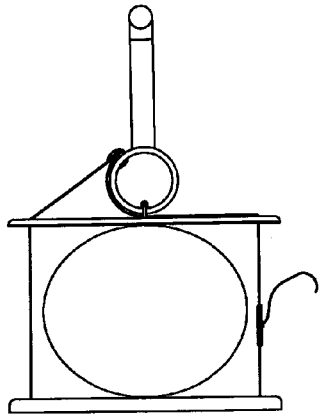

FIGS. 14, and 14A show an isometric, and side views of one section of the device mounted on the body in the initial position ready for performing body compressions.

Figure 15:
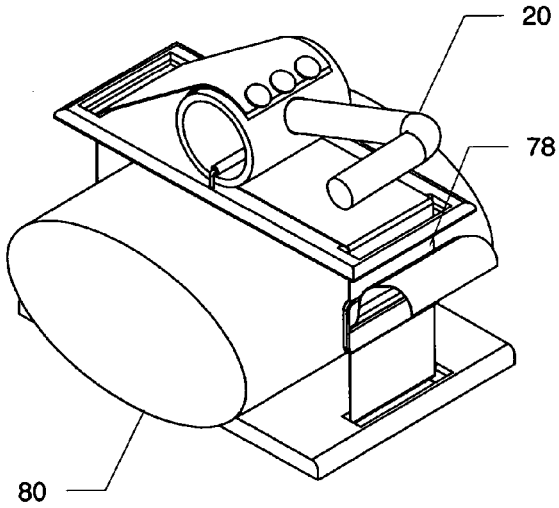
Figure 15A:
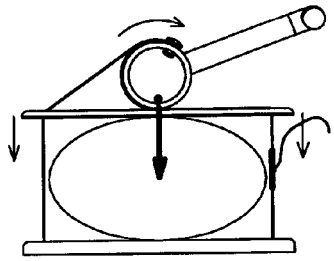

FIGS. 15, 15A illustrate an isometric, and side views of one section of the device during the compression cycle.

DETAILED DESCRIPTION

This section describes the preferred embodiment of the device of this invention. The purpose of this invention is to provide an improved device and method of performing CPR. Standard CPR is performed on an unconscious person in order to restore spontaneous heart action. The fundamental procedure is performed according to the guidelines of the American Heart Association, and the European Resuscitation Council, by rapidly compressing the sternum at a rate of about 100 compressions/min. It is a procedure that requires physical force and stamina on the part of the rescuer. Research indicates that enhancing the standard chest CPR with abdominal compressions may significantly enhance clinical outcomes.

The purpose of the device of this invention is to facilitate standard CPR or enhance standard CPR by adding abdominal compressions. The device comprises substantially two functional sections: the first section (to compress the thorax) and the second section (to compress the abdomen). Each section of the device is designed to apply the controlled force and controlled depth of compressions of the thorax and of the abdomen of the person being resuscitated, and to provide mechanical enhancement of the force that is required to accomplish the compressions. The first section and the second section can be used either separately, or in combination that is most advantageous for the treatment. The first section is applied around the thorax of the victim, at the level corresponding to approximately the lower ⅓ of the sternum, and the second section is positioned approximately over the epigastric area of the abdomen. The rescuer may use either both sections, or the first section only. For example, in order to perform standard CPR, the rescuer will use only the first section of the device, for performing chest and abdominal compression CPR, the rescuer will use both the first and the second section of the device and will actuate them either simultaneously, or alternatively in order to accomplish the desired action of compressions. Each section of the device permits the rescuer to control the force and the depth of compression of the thorax and of the abdomen of the person being resuscitated.

FIGS. 1, 1A, 1B, 1C illustrate the preferred embodiment of the device for performing standard CPR, in which only the one (first) section of the device is used. This section of the device comprises:

(a) the first board 26 that is placed on the chest of the victim, centered on approximately one-third of the lower portion of the sternum and extending laterally substantially beyond the sternum.

(b) a strap 24 that is eccentrically attached to the roller 22 of the actuator and routed around the body 34. The opposite ends of the strap are joined together using a buckle 30 that also serve to adjust the length and tightness of the strap around the body. The other two ends of the strap are attached to the roller 22 in such a manner that both ends of the straps wrap around the roller when the roller is rotated in the direction opposite to the attachment 32. The roller has a handle 20 attached in orientation substantially perpendicular to the roller's cylindrical surface. The board is equipped with a pair of strap routing guides 40 and 40*a* placed at the opposite ends of the board. The board material may be a rigid polymer, such as polyester-reinforced carbon fiber, ABS, nylon 66, metal, such as aluminum, preferably with electrically insulated surface, or other suitable material. Preferably, the board is padded on the body-facing side to help distribute the force acting on the body. Preferably, the board is also shaped to the body—facing side in order to assure contact and force distribution to the sternum and the ribs.

Figure 2A:
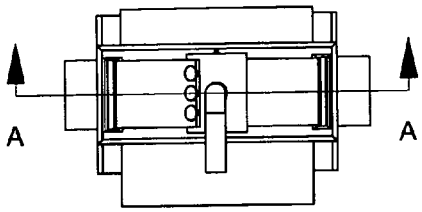
FIGS. 2, 2A and 2B show the single section of the device with the first board and the backboard board, shown in isometric, top and cross-section views, respectively.
Figure 2B:
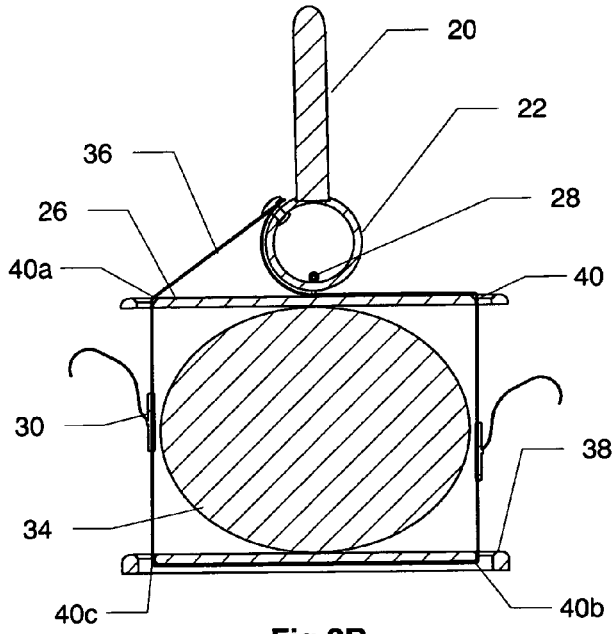
Figure 2:
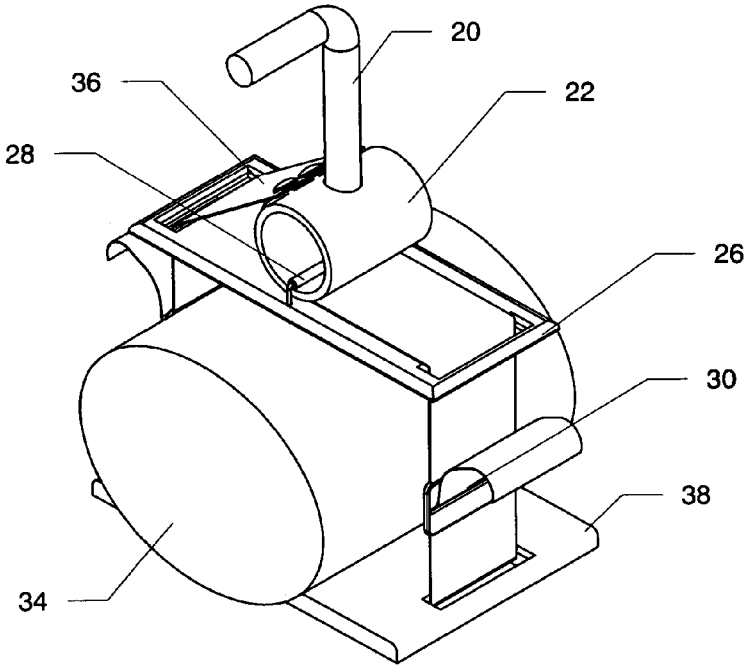

The roller 22 may be made of a suitable rigid material, such as PVC, nylon 66, aluminum, or the like. The roller may also be restrained from sliding, or rotating off the board by using a roller restraining guide 28. The roller restraining guide 28, shown in FIG. 2 and FIG. 2B, is placed inside the roller, with the ends attached to the board outside the roller. The roller restraining guide can be equipped with a rolling surfaces, such as a pair of bearings attached to the opposite ends of the roller, to facilitate the relative motion of the roller and the restraining guide.

Figure 1A:
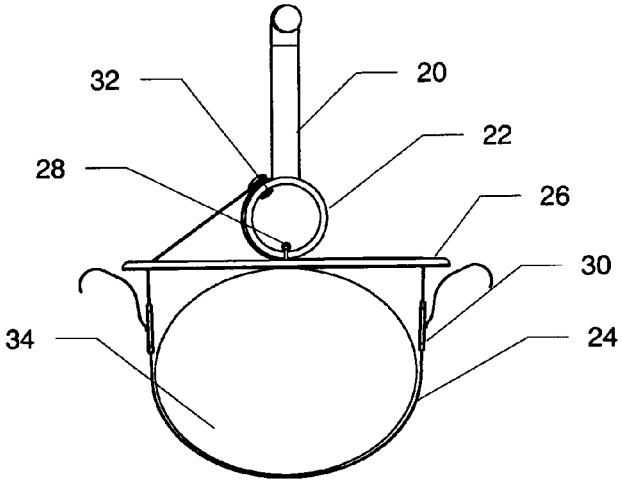
FIG. 1A illustrates the single section of the device with the first board and the first actuator deployed around a schematically-represented body, in side view.
Figure 1B:
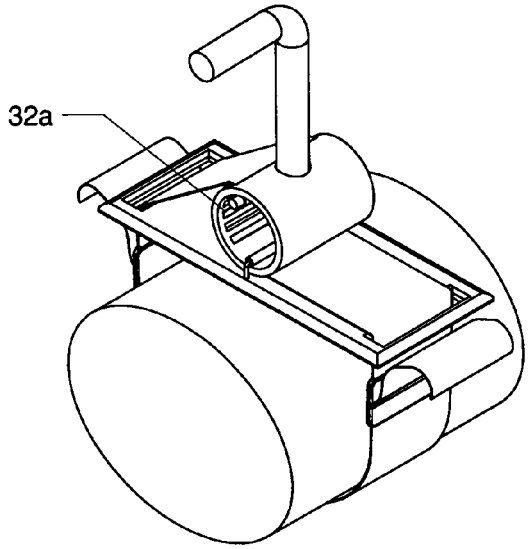
FIG. 1B illustrates the single section of the device with the first board and first actuator deployed around a schematically-represented body, in isometric view.
Figure 1:
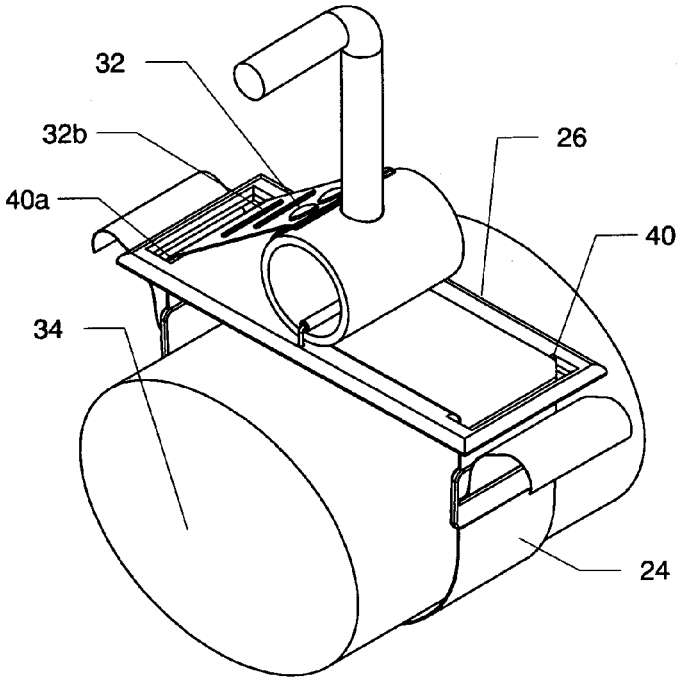
FIG. 1 shows an isometric view of the device with an actuator roller having the first board and a strap routed through the first board and around the body.
Figure 1C:
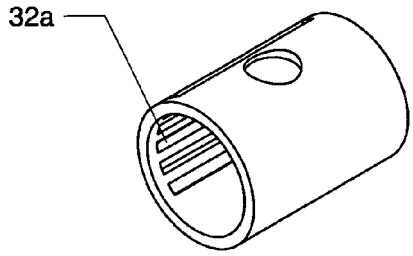
FIG. 1C illustrates a detail of the actuator roller with strap attachment slots.

The roller has straps attached to the same side of the roller. The straps can be attached using methods of attachment commonly known in the art, such as bolts, screws, and the like. The straps can also be attached in a manner that permit adjusting the placement of the attachment site 32 of the strap to the roller so that the depth of compression and the force of compression can be adjusted depending on the patient's body size, age, desired depth and force of compression. One method of attachment is shown in FIG. 1C. In this embodiment, the roller is fabricated with at least one slot in its side wall, parallel to the rotational axis of the roller. A short, tight loop is formed using the strap, and the end of such loop is inserted into the inside the roller through a slot opening 32*a* in the roller surface, and a retaining rod is inserted into the loop so that when the strap is tensioned, the rod wedges the strap against the sides of the slot and prevents the strap from sliding out of the roller.

The strap 24 is made of a substantially non-elastic, flexible material, such as woven polyester, nylon, and similar materials known in the art. The strap can also be made in the form of plurality of substantially non-elastic, flexible strings, cables, or like materials know in the art. The strap may have a plurality of depth compression indicator marks 32*b* to facilitate the estimate of the depth of compressions during treatment.

Other embodiments are envisioned that permit different methods of attaching the device to the victim. For example, the straps can be routed under the backboard or can be attached, on either one, or both sides, to the backboards using attachment loops, or brackets and hooks that affix the ends of the straps, opposite to the ends that are attached to the roller, to the backboard. Other attachment methods between the straps and the backboard, known in the art, are also contemplated. Yet another embodiment of the device uses multiple cables instead of the straps. The cables are attached to the rollers and routed in substantially the manner as the straps, exerting the same action. The cable material can be of steel, or polymer, such as nylon, or other suitable natural or synthetic, flexible cable material.

FIG. 2 shows the embodiment of the single section of the device using a backboard 38 to route the strap 36 slidedly around the body 34. FIG. 2B shows the preferred method of routing the strap through the strap routing guides 40, 40*a*, 40*b*, 40*c*, that are built into, or attached to the first board and to the backboard. FIG. 3 shows the assembly of the first and the second sections of the device using a single backboard 44 and illustrates the attachment of the ends of the straps 36, 36*a* to the rollers 22, 22*a* using rivets 32,32*a* or other suitable method of attachment. The rollers are equipped with a common handle that in this embodiment consists of two riser members 42*a*, 42*b* and a joining member 42*c*. The handle may also be made in variety of ways and the individual roller handles 20, 20*a* do not need to be connected, such as illustrated in FIG. 3B. FIG. 3A illustrates the construction of the device using two individual backboards 38, 38*a* that are placed underneath the body opposite their corresponding first board 26 and second board 26*a*.

FIG. 4 illustrates another embodiment of the device in which the strap 48, 48*a* is not routed underneath the backboard, but attached to the strap attachment loops 46, 46*a* that are mounted to the backboard. The attachments can be in the form of hooks, handles, loops, or other suitable devices for attaching the ends of the straps to the backboard.

FIGS. 5 and 5A show side, and isometric views of yet another possible attachment of the straps to the backboard, or any other suitable platform on which the victim can be placed in recovery position and which is equipped with suitable components for strap attachment. In this embodiment, the straps 52 and 52*a* are equipped with "quick-release" hooks 54 and 54*a* that can be attached to the strap attachment loops 50, 50*a*. Alternatively, the device of this invention can be used with the backboards being replaced with the stretcher, bed, or another firm surface supporting the victims to which the straps can be attached using methods of strap attachment known in the art. In yet another embodiment of the device, either one, or all boards can be adjustable in length, permitting extension of the boards beyond the perimeter of the body thus taking full advantage of translating the change in the straps' length during the winding of the straps around the rollers, into the change in the distance between the boards, without exerting substantial circumferential force on the thorax. An example of such adjustable board is shown in FIG. 11A.

FIG. 6 illustrates an embodiment using both the first and the second sections of the device, in which the actuator rollers are joined with a roller connecting member 56 in order to improve positional and rotational synchronization of the actuators. The roller connecting member can be fabricated using any number of flexible, or semi-flexible materials that permit bendability with substantial torsional rigidity. Examples of such materials include a thick-walled rubber cylinder, a solid cylinder of polymeric or rubber material, for example, silicon rubber, and the like.

FIG. 7 provides an illustration of an embodiment in which the second roller 58 is of a different size than the first roller 22; It is also contemplated that the rollers can be equipped with various devices for sensing, controlling or limiting the force, pressure or torque that is exerted by the rollers on the boards, or on the body, and for communicating such information to the rescuer by using visual, audio, or both, communication devices. Examples of such devices include displays, buzzers, lights and the like user interface devices known in the art.

FIGS. 8, 8A, and 8B show an embodiment of the device in which the ends of the actuator roller are equipped with bearings 60, 60*a*, or bushings in order to facilitate rotation of the roller with respect to the board. The inside surface of the bearings is attached to the roller, while the outer surface rests on the upper surface of the board, as illustrated in FIG. 8.

In order to accommodate different body sizes of the victims, or to exert different, pre-set forces and compressions, the device using both the chest and the abdominal section can be equipped with an adjustable handle (FIG. 9). The adjustable handle consists of an adjustable length riser 66, an internal telescoping handle 62*a* and a latch 62. Similarly, the length of the common handle can be adjusted by using an internal telescoping handle member 64, an external telescoping handle member 64*b* and a latch 64*a* that together form an adjustable handle, enabling the adjustment of the distance between the device's first and second section, matching the length of the backboard 82. It is also contemplated that the handles can be equipped with various devices for sensing, controlling or limiting the force, pressure or torque that is exerted by the rollers on the boards, or by the boards on the body, and for communicating such information to the rescuer by using visual, audio, or both, user interface devices. Examples of such interface devices include displays, buzzers, lights and the like user interface devices known in the art.

When the rollers are rotated, it is desirable to provide methods and devices for sensing, controlling, or limiting the force and/or torque that the actuator is exerting on the board, and through the first and/or the second board, on the body. For this purpose, the actuators can be fitted with sensors 70, that can be mounted to, or between the roller, and the first or second board, so that the force, torque, angle and depth of compression can be measured. (FIG. 10). These sensors and controllers can be mechanical, or electromechanical, or can be fabricated and mounted in a number of ways known in the art.

FIG. 11 illustrates the use of the device with a smaller-size second board 26*b* that permits yet another control of the force acting on the abdomen, and of the depth of abdominal compression, and provides improved protection against excessive displacement of the internal organs in the abdomen.

An example of an alternative embodiment is the device in which the size of the abdominal roller is different than the size of the thoracic roller, providing different depth of compression of the abdomen and of the thorax, as well as different force advantage of each compression site.

The boards are important components of the device and can be made in a number of ways, some of which are illustrated in FIGS. 11A, 11B, and 11C. FIG. 11A shows an extendable board, which comprises two sections forming a set of rails that allow one section 72*a* of the board to slide outwardly and latch in position, extending the length of the board 72. The same figure also illustrates a possible embodiment of the strap routing guide which can be made by rounding the edge of the opening in the board 40, or by using a rotating pulley 74, illustrated in FIG. 11B. In order to effect the best possible fit and contact between the device and the surface of the victim's body, the chest board can be equipped with a contoured body-facing surface 76 (FIG. 11C). The board can also be padded on the body-facing side. The contoured and padded boards facilitate distribution of the compression force, and minimize patient's discomfort during compressions. An alternative board design that provides improved distribution of the compressing force on the body is shown in FIG. 11D, where the board consists of three sections, hingedly 82 attached in such a manner that the main section forms a base for the actuator roller, and the side sections angle towards the body. It is also contemplated that the boards can be equipped with various devices for sensing, controlling or limiting the force, pressure or torque that is exerted by the rollers on the boards, and for communicating such information to the rescuer by using visual, audio, or both, user interface devices. Examples of such interface devices include displays, buzzers, lights and the like user interface devices known in the art.

The device of this invention may be constructed using either one roller handle, common for both rollers for simultaneous compression of the thorax and the abdomen, or may be constructed using a separate handle for each roller, permitting independent operation of the thoracic and abdominal sections of the device. FIG. 12 shows the device in configuration allowing for both SAC and IAC. The straps 36 and 36*a* in the first and the second section of the device are mounted on opposite side of the corresponding rollers, permitting winding in the opposite directions, meaning the winding action will occur when one roller is rotated in the clockwise direction, while the other roller is rotated in the counterclockwise direction. Such a configuration allows operating the device by pressing on the roller handles on both sides of the body, providing for more balanced operation of the device.

If the actuator rollers with straps mounted according to the above description are rotated in the same direction using handles 20, and 20*a*, the first strap is wound around the roller 36 while the second strap is unwound from the roller 36*a* creating an interposed compression-decompression cycles. Because the device represented in FIG. 12 permits the actuation of each section of the device separately, asynchronously or synchronously, in the same, or opposite directions, it enables the rescuer to perform a standard, interposed or simultaneous CPR using the same device. By contrast, the device with a common handle 42 as shown in FIG. 13 is designed to be used by a single rescuer for performing the IAC-CPR.

The device illustrated in the above figures is modular, and a number of device combinations for performing different CPR procedures, that may be deemed by the rescuer as advantageous to the patient, can be assembled.

Different embodiments of the device of this invention are possible that emphasize different aspects of the CPR treatment. In order to realize different advantages of the device, different device parts can be altered, and can be assembled in a manner that is the most appropriate for the treatment.

Operation of the Device of this Invention

This section describes the principles of operation of the device and method of the invention. The objective of using the device and method for improved cardiopulmonary resuscitation is to facilitate repetitive compressing of the chest, or of the chest and the abdomen. Examples of treatments that require different combinations of the chest, or chest and abdominal compressions, for which the device of the present invention can be applied, are Standard CPR (chest compression only), the Simultaneous Abdominal Compression CPR, or Interposed Abdominal Compression CPR.

The device of this invention can be operated using either a single section to perform compressions of the chest only, or two sections, the first section to perform compressions of the chest and the second section to perform compressions of the abdomen.

Operation of the single section device is illustrated in FIGS. 14, 14A, 15, and 15A, and comprises the following steps:

(1) Preparation of the Device and Attachment of the Device to the Patient for Standard CPR (Chest Compression Only). (FIGS. 14, and 14A)

First, the device is attached to the victim by placing the person 34 in the recovery position with his/her back on the first backboard 38 of the device. The first board is then placed on the chest of the victim being resuscitated, so that the body-facing side is centered on both sides, at the level of lower ⅓rd of the sternum, and remains in contact with the sternum and the ribs on both sides of the sternum. The strap 36 is routed around the patient's body, as illustrated in FIG. 14A. The ends of the strap are attached to the same side of the roller surface, and the strap that is mounted externally with respect to the other strap, is routed around, or through the strap routing guide on the same side of the board as the strap attachment site. The other strap, mounted proximally to the roller surface, and similarly through, or around the second strap routing guide on the other side of the board. The strap routing guides at the sides of the first board, and of the backboard, change the routing direction of the strap. The eccentric with respect to the roller, and the roller handle, mounting of the straps to the roller results in the mechanical advantage of a lever that is created when the roller is rotated using the handle 20 in the direction causing the wrapping of both belts around the roller. The length of the strap is adjusted until the board fits snugly on the chest with the roller remaining in neutral position with the handle 20 directed substantially perpendicularly to the board, and the board remains substantially parallel to the backboard. The length of the board is adjusted so that the straps do not exert an appreciable force on the sides of the chest, while transferring the direction of the force tensioning the straps in the direction substantially perpendicular to the board, thus pulling the board towards the backboard and exerting compressing action on the chest. Additionally, the first board is positioned in such a manner that the compression is exerted between the first board, and backboard, approximately upon the ⅓ lower part of the anterior rib cage and the sternum.

In order to perform a CPR with the compression of the abdomen, either simultaneous or interposed, the first and the second sections of the device are used. The second section comprises the same elements, and similar routing as the first section except that the second actuator roller can be of different in size than the first actuator roller, and the second board can be of different size than the first board.

The second board is placed on the upper abdomen of the victim in such a manner that the center of the board corresponds to the centerline of the body and the inside edge of the abdominal board is substantially at the level of the victim's navel. The inside edge is defined as the edge facing the other board.

(2) Actuation of the Device.

FIGS. 15 and 15A illustrate the operation of the device between the endpoints of the compression cycle. In order to perform resuscitation by compressing the victim's thorax, the roller is rotated by pulling on the roller handles in such a manner that the straps are wound around the roller. When the strap is wound on the roller, the length of the loop formed by the strap around the body is shortened and, due to the change in direction caused by the strap's routing through the strap routing guides, the board is pulled towards the backboard, exerting a compressing force on the thorax. When the first board is forced closer in the direction towards the backboard, the thorax is compressed (FIG. 15A). Maximum compression is accomplished when the roller has been rotated approximately 90 degrees, i.e., the roller handle nave reached a substantially horizontal position. During the compression part of the cycle, the blood is pushed through the inactive right heart of the unconscious person into the lungs, and from the lungs, through the inactive left heart to the aorta, coronary arteries and vital organs. After the compression to the desired level is accomplished, the handles are restored to their original neutral (vertical) position, allowing the thorax to recoil to the original position, drawing blood into the inactive heart.

The compression of the abdomen takes place when the second section of the device is used. The operating principle of the second section is the same as one described above for the thorax compression.

Advantages of the Device of the Invention Over the Existing Devices for Performing CPR.

The described invention has significant advantages over the currently existing methods of resuscitation by external thoracic massage. The device of this invention provides mechanical force advantage, dependent on the specific embodiment and construction of the device, that allows applying the compression-decompression cycles with significantly (between 2 and 10 times) less effort than that required during resuscitation with manual compression of the thorax. The device of this invention results in the compression of the thorax towards the spine in a manner similar to that when using the standard, unaided external thoracic massage, as opposed to other devices known in the art that provide circumferential compression of the rib cage. The device also permits applying the compressions in the uniform and reproducible manner, determined by the initial and final position of the roller. The reproducibility and uniformity of the compressions is further improved by the device including a sensing and/or control component selected from a group comprising a force gauge, a force indicator, a torque gauges, or a torque limiter. The device of this invention permits safe and reproducible compressions of the thorax as compared to the manual resuscitation, and can prevent victim injury that otherwise is common due to the lack of control of the depth and force of compression of the sternum during standard manual resuscitation. The device also enables the rescuer to control the force and depth of compressions that are known to be age-dependent.

Compressing the abdomen using the device of this invention results in an improved return of blood from abdominal vessels to the heart, and in the higher intrathoracic pressure, which is accomplished by preventing the downward displacement of the victim's diaphragm during compressions of the thorax. Unlike other devices known in the art, the device of this invention is universal as it enables applying both the Standard CPR, as well as modified CPR procedures, such as Simultaneous Abdominal Compression CPR or Interposed Abdominal Compressions CPR.

EXAMPLE

As an example, the device according to this invention was built and the characteristics of the device operation—the force required to exert the target compression force of 50 kG at each roller, was measured. The device was constructed using PVC materials with polyester strap and HDPE front chest and abdominal board. The backboard was made of rigid plastic and had a surface allowing for sliding of the strap underneath the board. The force of compression was measured using a platform weighing scale, while the force required to pull the common handle was measured using a 50 kG-range spring pull scale. The rollers measured 7 cm in diameter, and the handle extended 17 cm from the surface of the roller to the center of the connecting member of the handle where the pulling force was applied and measured. The boards measured 30×10 cm and the 5 cm wide strap was routed through the routing guides fabricated in the openings in the boards. The compression force of approximately 100 kG (50 kG per roller) was obtained by applying the pulling force on the handle of approximately 20 kG in the direction perpendicular to the handle and tangential to the handle trajectory during the compressive motion.

Conclusion, Ramifications, and Scope of Invention

While the above description contains many specificities, these should not be construed as limitation on the scope of the invention, but rather as an exemplification of one preferred embodiment thereof. Many other variations are possible without departing from the spirit of the invention. Accordingly, the scope of the invention should be determined not by the embodiments illustrated, but by the appended claims and their legal equivalents.

We claim:

1. A device for performing CPR by applying body compressions, comprising:

a substantially inflexible, rigid first board, adapted to be located on the anterior region of the thorax, extending laterally substantially beyond the medial region of the thorax and providing means for applying pressure on the anterior part of the thorax, a first actuator urging on said first board, a substantially non-elastic first strap, extending downwardly from the ends of the rigid board wherein the strap is not exerting substantial forces on the lateral part of the thorax, wrapping conformally or non-conformally around the posterior thorax, and connected to said first actuator, a second board adapted to be located on the abdomen, a second actuator urging on said second board, and a substantially non-elastic second strap wrapping around the lumbar region and connected to said second actuator.

2. A device according to claim 1, wherein said first actuator or said second actuator comprises:

a roller capable of rotating on the board;

a strap with the ends attached to the same side of said roller in such a manner that both ends of the strap wrap around the roller when the roller is rotated, and the remaining portion of the strap form a loop around the body wherein said loop is shortened when the roller is rotated, whereby thrusting the board substantially perpendicularly towards the body.

3. A device according to claim 2 wherein a means of actuating the roller is attached to said roller.

4. A device according to claim 3 wherein the means of actuating the roller is a handle attached to said roller.

5. A device according to claim 4 wherein the handle of said first actuator and the handle of said second actuator are connected to form one, common handle.

6. A device according to claim 1, wherein the length of the board is adjustable to accommodate different individual lateral body dimensions.

7. A device according to claim 1 wherein the board contains a component selected from the group of means for measuring, controlling, and limiting the force, and the depth of compressions.

8. A device according to claim 1, wherein the strap consist of one or more interconnected strap segments and at least one said segment length is adjustable.

9. A device according to claim 8, wherein said interconnected strap segments contain an element selected from the group consisting of a belt, a cable, a string, a tendon and a plurality of belts, a plurality of cables, a plurality of strings, and a plurality of tendons.

10. A device according to claim 9, wherein the strap segment disposed under the body is replaced by a backboard.

11. A device according to claim 10, wherein said backboard contains strap attachment means.

* * * * *